US007128541B2

(12) United States Patent
Käch

(10) Patent No.: US 7,128,541 B2
(45) Date of Patent: Oct. 31, 2006

(54) OSCILLATING DISPLACEMENT PUMP

(75) Inventor: Robert Käch, Sursee (CH)

(73) Assignees: KNF Flodos AG, Sursee (CH); Robert Bosch AG, Hallein (AT)

( * ) Notice: Subject to any disclaimer, the term of this patent is extended or adjusted under 35 U.S.C. 154(b) by 239 days.

(21) Appl. No.: 10/474,086

(22) PCT Filed: Mar. 27, 2002

(86) PCT No.: PCT/EP02/03411

§ 371 (c)(1),
(2), (4) Date: Oct. 6, 2003

(87) PCT Pub. No.: WO02/081918

PCT Pub. Date: Oct. 17, 2002

(65) Prior Publication Data

US 2004/0105764 A1 Jun. 3, 2004

(30) Foreign Application Priority Data

Apr. 6, 2001 (DE) ..... 101 17 418

(51) Int. Cl.
*F04B 23/00* (2006.01)

(52) U.S. Cl. ..... 417/440; 417/540; 417/542

(58) Field of Classification Search ..... 417/413.1, 417/540, 542, 440

See application file for complete search history.

(56) References Cited

U.S. PATENT DOCUMENTS 2,405,466 A 8/1946 Tabb
2,458,933 A * 1/1949 Dodson ..... 137/115.25
2,662,723 A * 12/1953 Coffey ..... 137/854
3,192,864 A * 7/1965 Notte ..... 417/540
3,209,700 A * 10/1965 Waldherr ..... 92/100
3,779,669 A * 12/1973 Sommer ..... 417/214
4,248,050 A * 2/1981 Durenec ..... 62/6
4,385,869 A * 5/1983 Omata ..... 417/271
4,459,089 A * 7/1984 Vincent et al. ..... 417/383
4,594,059 A * 6/1986 Becker ..... 417/439
5,461,966 A * 10/1995 Becker et al. ..... 92/1
5,676,531 A * 10/1997 Muscarella et al. ..... 417/413.1
6,327,961 B1 * 12/2001 Rozek ..... 92/140

FOREIGN PATENT DOCUMENTS

GB 1111153 4/1968

* cited by examiner

*Primary Examiner*—Anthony D. Stashick
*Assistant Examiner*—Vikansha Dwivedi
(74) *Attorney, Agent, or Firm*—Volpe and Koenig, P.

(57) ABSTRACT

An oscillating displacement pump, particularly a diaphragm pump (P) for liquid or gaseous delivery media, having a delivery space which on the one side is delimited by a pump head and on the other side by a delivery element, particularly formed by a diaphragm (6). The delivery element is drivingly connected to an eccentric drive, and an inlet valve connected to an inlet connection and an outlet valve connected to an outlet connection are connected to the delivery space. The pump has a pulsation damper (45) on the pressure side, and also an excess pressure limiting device (27) between the pressure and suction sides, these devices being integrated into the pump head. In use as a liquid pump, an oscillation chamber (16) is integrated into the suction side of the pump head. Pressure peaks are thereby diminished both on the suction side and the pressure side, and a pressure rise on the pressure side is limited to a predeterminable value.

12 Claims, 2 Drawing Sheets

OSCILLATING DISPLACEMENT PUMP

BACKGROUND

The invention relates to an oscillating displacement pump for liquid or gaseous delivery media, with a delivery space which is delimited on one side by a pump head and on the other side by a delivery element which is drivingly connected to an eccentric drive, an inlet valve with an inlet connection and an outlet valve with an outlet connection being connected to the delivery space, the pump having a pulsation damper at least on the pressure side, and also an excess pressure limiting device between the pressure side and the suction side; in particular, a diaphragm pump with a delivery element formed by a diaphragm.

Diaphragm pumps, which are used as liquid pumps or else as gas pumps, work on the principle of oscillating displacement pumps. This principle naturally causes pulsation on both the suction and the pressure sides. Pulsation on the pressure side in diaphragm pumps, and in particular in fast-running diaphragm pumps, can cause cavitation, pressure peaks, and vibrations.

The harmfulness of cavitation in liquid pumps is known. In addition it causes noise and leads to unstable delivery amounts.

Pressure peaks can damage, or affect the functioning of, devices fitted in the suction conduit. Vibrations cause noise and are transmitted to peripheral devices or to the same device.

In diaphragm pumps, pulsation on the pressure side causes pressure peaks and vibrations. The effects are the same as on the suction side but more radical, since on the pressure side—in contrast to the suction side—the pressure peaks can rise much higher.

With a closed or blocked system, diaphragm liquid pumps compress a liquid until the weakest link in the chain yields. This leads to damage to this element.

From U.S. Pat. No. 2,405,466, a pump of the above-mentioned type is known. This has a suction-side and a pressure-side damper, respectively with a damping chamber filled with air. A disk with one or more apertures, or of porous material, is provided between the damping chamber and respectively the inlet chamber or the outlet chamber. This partially permeable disk between the air filling and the liquid delivery medium in the inlet chamber or respectively the outlet chamber is to prevent the damping air cushion being entrained with the liquid stream.

Such a damping device can only work with the pump used in a position in which the damping chambers are oriented upwardly. Furthermore, the pump is only provided for delivery of liquids, and finally the damping chambers are comparatively quite voluminous for sufficient damping.

SUMMARY

The present invention has as its object to provide a displacement pump, particularly a diaphragm pump for liquid or gaseous media, in which pressure peaks are avoided on both the suction side and the pressure side, and which also satisfies elevated safety requirements and moreover in spite of this has a compact construction.

To attain this object, it is proposed that a connection block is provided as a portion of the pump head, and has integrated into it at least one pulsation damper, an excess pressure limiting device, and also, when used as a liquid pump, an oscillation chamber, and which has an inlet connection and an outlet connection; that the pressure-side pulsation damper has at least one damping chamber, which is divided by means of a separating diaphragm into a receiving space for damping elements and a region conducting delivery medium; the damping elements of resiliently elastic material are arranged within the damping chambers; the pressure-side pulsation damper is connected via an outlet throttle member to an outlet, which in turn is connected to the pressure-side duct connection forming the outlet connection, and that the excess pressure limiting device, connected between the pressure and suction sides of the pump, has its pressure side connected to the pressure-side duct connection.

By the integration of all the devices provided for pulsation damping and for excess pressure limiting in the connection block of the pump, a particularly compact structure results. Connecting conduits which would be necessary in a separated arrangement of the devices are avoided. Moreover, such a connection block also permits an optimum arrangement of the individual devices, and the possibility exists of providing one or other device as required, and thus considering adaptation to different applications, and also deactivating unused devices, for example by blank covers. Manufacture is also thereby simplified.

By means of the pressure-side pulsation damper with the division of the damping chamber(s) by means of a separating diaphragm into a receiving space for damping elements and a region conveying delivery medium, the damping elements do not have to come into contact with the delivery medium, so that the damping elements used can be determined exclusively by the required damping properties, and are not required to be resistant to the respective delivery medium. Hence even aggressive delivery media can be used without problems by corresponding choice of the separating diaphragm. Moreover the pump can be operated independently of position, because of the separating diaphragm between the receiving space for damping elements and the delivery medium.

The oscillation chamber integrated into the suction-side portion of the pump head when in use as a liquid pump has an oscillating diaphragm which divides the oscillation chamber into a chamber portion connected to the suction side and a chamber portion connected via an aperture to the ambient air. When a liquid is delivered, due to this suction-side pulsation damping, the liquid flow is not abruptly stopped on closing the inlet valve, but can be kept somewhat "in flow" by the excursion of the oscillating diaphragm which then occurs. A pulsation on the suction side can thereby likewise be effectively reduced, and in particular, in rapidly running diaphragm pumps, cavitation, pressure peaks and vibrations can be avoided. Furthermore, noise is damped and an unstable delivery amount is avoided.

Pressure monitoring or pressure limitation is present by means of the excess pressure limiting device, and the pump is protected from damage when the pressure rises due to a closed or blocked system.

The excess pressure limitation which is mounted between the pressure and suction sides of the pump head acts to set the maximum permissible pressure on the pressure side of the pump, or to maintain a constant pressure on the pressure side of the pump, independently of the amount of throughflow.

The present invention thus reduces pressure peaks, both on the suction side and on the pressure side, and by means of the excess pressure limiting device, limits the pressure rise on the pressure side to a pre-settable value.

By the arrangement of the pressure-side pulsation damper with its outlet throttle member before the pressure-side connection of the excess pressure limiting device, the latter can be set to the already smoothed pressure, so that pressure peaks no longer have to be taken into account. Pressure peaks occur at the excess pressure limiting device only in damped form, so that the excess pressure device can thereby be set more sensitively and precisely, and in particular the setting can take place very close to the operating pressure.

Constructional advantages also arise thereby providing a possible small constructional form of the pump, since a backflow of forwarding medium via the excess pressure limiting device is effectively little or not at all present, and thus the full delivery amount is also effectively available.

If the pressure side of the excess pressure limiting device were to be acted on with practically undamped pressure, as is the case in the prior art according to U.S. Pat. No. 2,405,466-A, a comparatively high backflow would be present and thereby a reduced effective pump performance. Such a pump would correspondingly have to be designed for a higher delivery amount in order to produce an effective delivery flow, and this however makes the pump larger and more expensive.

In particular, in applications in which the operating pressure should be exceeded only slightly and thus the pressure setting of the excess pressure limiting device is situated close to the operating pressure, the pressure peaks which arise lead to the excess pressure limiting device responding and passing a portion of the delivery flow back from the pressure side to the suction side, so that a correspondingly lower performance arises as regards delivery amount.

These disadvantages are avoided with the pump according to the invention.

Furthermore, by the arrangement of the pressure-side pulsation damper with its outlet throttle member before the connection of the excess pressure limiting device, it is advantageous in the pump according to the invention that the damping effect is precisely predetermined by the throttle integrated into the pump, and thereby a precise setting of the excess pressure limiting device before the delivery of the pump and the connection to peripheral devices is made possible.

It is preferably provided that the pump head has a cubic form of pump head housing, with a connection side for an intermediate plate having the valves, a connection side with the excess pressure limiting device opposite to this, and that oppositely on the four other peripheral sides, the inlet connection and the outlet connection, and also the pressure-side pulsation damper and if necessary the suction-side oscillation chamber are mounted. The built-in or built-on parts—excess pressure limiting device, pulsation damper, oscillation chamber—of the pump head are thereby accessible independently of each other and thereby, among other things, easily mountable and demountable.

An embodiment of the pressure-side pulsation damper provides that this has at least two damping chambers connected in series within the pump head or within a damper housing belonging to the pump head, and that for this purpose a duct section connected to an inlet has a connecting channel to a first damping chamber and is also connected via an inlet throttle member to a second damping chamber connected via an outlet throttle member to an outlet.

By the connection of plural damping stages in series, a high damping is achieved, which increases exponentially with the number of damping stages. The throttle members, in connection with the damping chambers, form damping units which can intermediately store delivery medium when pressure fluctuations occur and can release it again. During a pressure peak, a dynamic pressure is built up by the throttle members, by means of which a pressure loading of the damping units and a throttled release of delivery medium is possible in the pressure drop phase following the pressure phase.

Additional embodiments of the invention are set out in the further dependent claims.

BRIEF DESCRIPTION OF THE DRAWINGS

The invention is described in detail hereinafter with its essential details, based on the drawings.

DETAILED DESCRIPTION FO THE PREFERRED EMBODIMENT

Figure 1:
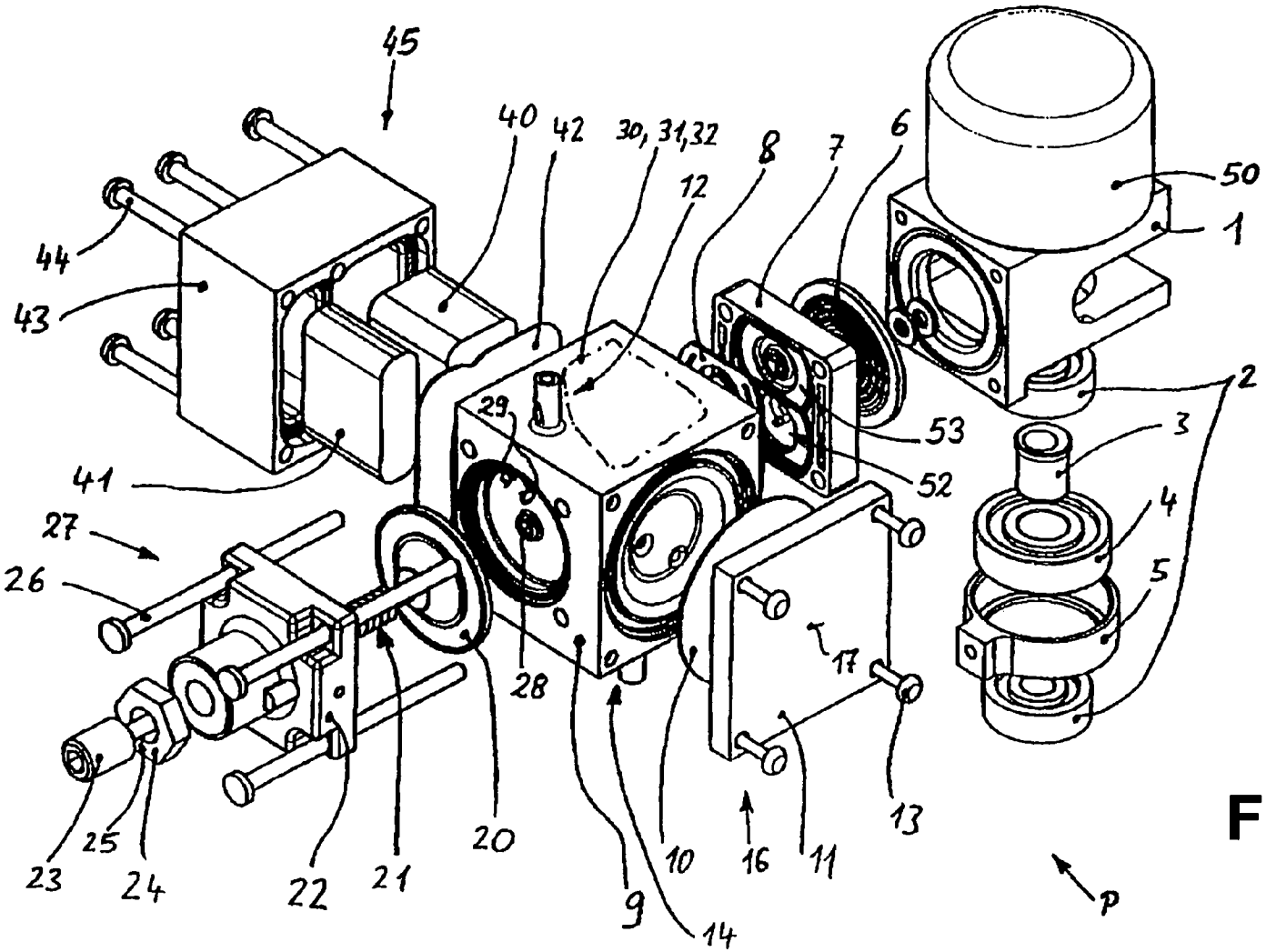
FIG. 1 shows an exploded view of a diaphragm pump according to the invention.

A pump P shown in the Figure has a pump housing 1, to which a motor 50 is laterally connected via a flange. A crank drive for a pump diaphragm 6 has two crankshaft bearings 2, an eccentric 3 and a connecting rod bearing 4. A connecting rod 5 has a connection location by means of which it can be connected to the pump diaphragm 6. When the crank drive rotates, the pump diaphragm is set in a stroke movement.

An intermediate plate 7 is mounted on the pump housing 1, and a delivery space 59 is formed between it and the pump diaphragm 6. The intermediate plate 7 includes an inlet valve 52 and an outlet valve 53 when a valve plate 8 is located thereon. The intermediate plate 7 and the thereto adjoining connection block 9 substantially form the pump head.

The connection block 9, as a part of the pump head, is of approximately cubic in form in the exemplary embodiment. One of the six sides forms a connection side for the intermediate plate 7. On the opposite side, the functional portions of an excess pressure limiting device 27 are shown. This acts to set the maximum permissible pressure at the pressure side 54 of the pump, and for this purpose has a flow connection between pressure side 54 and suction side 55, normally closed in operation by an overflow valve.

In the exemplary embodiment, a pressure regulating diaphragm 20 engages in an inner cavity of the connection block 9 and sealingly abuts there on an aperture 28 connected to the suction side. The pressure regulating diaphragm 20 has a spring 21 acting on it, the pressure applied being adjustable by means of an adjusting screw 23. A guard nut 24 with a washer 25 beneath it acts to secure the respective setting of the adjusting screw 23.

In the mounted position, the inner cavity of the connection block 9 for receiving the pressure regulating diaphragm 20 and the like is closed by a pressure cover 22, which is held by screws 26. Another aperture 29, again connected to the pressure side, can be seen within the recess.

Opposite on two of the other four sides of the connection block 9 are located on one side a conduit connection 14 (inlet connection) and on the other side a conduit connection 12 (outlet connection).

The two other peripheral sides of the connection block have on the one side a pulsation damper 45 connected to the pressure side and on the other side an oscillation chamber 16.

The pulsation damper 45 has a large damping element 40 and a small damping element 41, which are situated in separate damping chambers 56, 58. The damping elements can differ in their mass and/or their volume.

Figure 2:
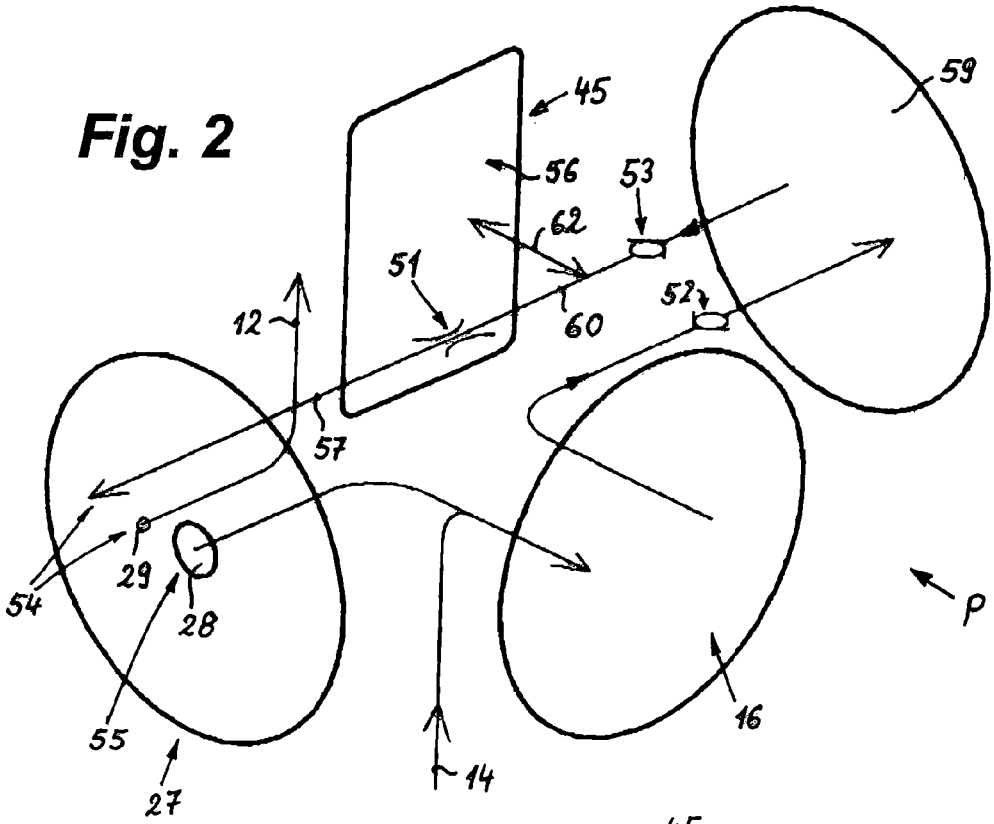
FIG. 2 is a schematic representation of the pump of FIG. 1 having a single level pulsation damper.
Figure 3:
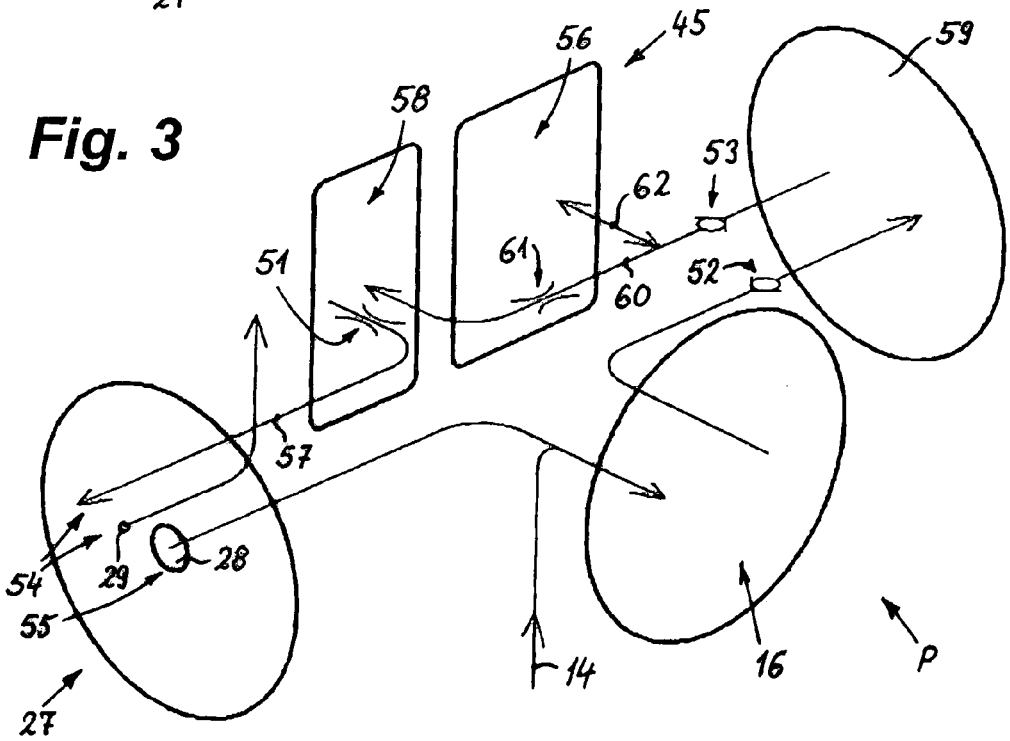
FIG. 3 is a schematic representation of the pump of FIG. 2 having a two level pulsation damper.

The two associated damping chambers 56, 58 are connected together (FIGS. 2 and 3) by a duct section 60. This duct section 60 has a pressure-side inlet with a connecting channel 62 to the first damping chamber 56. The duct section 60 is connected via an inlet throttle member 61 to the second damping chamber 58, which in its turn is connected via an outlet throttle member 51 to an outlet which in turn is connected to the pressure-side duct connection 57.

The damping elements situated within the damping chambers are formed of elastically resilient material.

The damping chambers of the pressure-side pulsation damper 45 are divided by a separating diaphragm 42 into a receiving space for the damping elements 40, 41 and a region conducting delivery medium.

In the embodiment example, a damper cover 43 is provided as the outer closure of the pulsation damper 45, and can here have a portion or the whole of the volume of the damping chambers. On the other hand, there otherwise exists the possibility that the damping elements are completely integrated into the connection block 9. The damper cover 43 is held onto the connection block 9 by screws 44.

The oscillation chamber 16 is situated on the side opposite the pulsation damper 45. This oscillation chamber has an internal cavity in the connection block 9, connected to the suction side. An oscillating diaphragm 10 divides the oscillation chamber into a chamber portion connected to the suction side and a chamber portion connected via an aperture 17 with the exterior.

A closure cover 11 acts to hold the oscillating diaphragm 10 and as the closure of the oscillation chamber, and is held by screws 13 onto the closure block 9.

A suction-side pulsation damper is formed by the oscillation chamber 16. By different choice of the diameter/thickness ratio of the oscillating diaphragm 10, the oscillation damping can also be optimized in dependence upon the respective delivery medium.

It is furthermore shown by a dot-dash line that a heating arrangement can be integrated into the pump head or the connection block 9. This can involve (not shown in detail) a heating plate 30 including cable connections, possibly a heat distribution plate 31, and also possibly a cast-in mass 32. In corresponding pressure and temperature conditions, freezing-up of the pump head can thereby be avoided, or else pump head if frozen in can be thawed out.

What is claimed is:

1. Oscillating displacement pump for delivery of liquid or gaseous media, with a pressure side and a suction side, a delivery space which is delimited on one side by a pump head and on the other side by a delivery element which is drivingly connected to an eccentric drive, an inlet valve (52) with an inlet connection (14) and an outlet valve (53) with an outlet connection being connected to the delivery space (59), the pump (P) having at least one pulsation damper (45) at least on the pressure side (54), and also an excess pressure limiting device (27) between the pressure side (54) and the suction side (55), the pump being a diaphragm pump with the delivery element being formed by a diaphragm (6), wherein a connection block is provided as a portion of the pump head, and has integrated into it the at least one pulsation damper (45), the excess pressure limiting device (27); the pulsation damper (45) has at least one damping chamber (56), which is divided by a separating diaphragm (42) into a receiving space for damping elements (40, 41) and a region conducting delivery medium; the damping elements (40, 41) are made of a resiliently elastic material and are arranged within the at least one damping chamber; the at least one pressure-side pulsation damper (45) is connected via an outlet throttle member (51) to an outlet, which in turn is connected to a pressure-side conduit (57) connection which forms the outlet, and the excess pressure limiting device (27), connected downstream of the at least one pulsation damper (45) and between the pressure and suction sides (54, 55) of the pump, has a pressure side that is connected to the pressure-side conduit connection (57).

2. Pump according to claim 1, wherein the excess pressure limiting device (27) is adjustable between the pressure and suction sides of the pump for setting a maximum permissible pressure on the pressure side of the pump.

3. Pump according to claim 1, wherein the excess pressure limiting device (27) has a connection between the pressure side (54) and the suction side (55) of the pump, and wherein an overflow valve (20, 28) is inserted into the connection.

4. Pump according to claim 3, wherein the overflow valve of the excess pressure limiting device (27) is adjustable and has a spring-loaded pressure regulating diaphragm (20), the spring loading of which is adjustable with an adjusting screw (23).

5. Pump according to claim 1, wherein the pump head has an approximately cubic pump head housing (9), with a connection side for an intermediate plate (7) having the valves, and with an opposite connection side with the excess pressure limiting device (27), and wherein oppositely on at least two of the other four peripheral sides are mounted the inlet connection (14) and the outlet connection (12), and also the pressure-side pulsation damper (45) and the suction-side oscillation chamber (16).

6. Pump according to claim 1, wherein the pressure-side pulsation damper (45) has at least two damping elements (40, 41) which differ in at least one of mass and materials, and/or include damping chambers which differ in volume.

7. Pump according to claim 1, wherein the pressure-side pulsation damper (45) has at least two damping chambers (56, 58) connected in series within the pump head or within a damper housing (43) of the pump head, wherein for this purpose a duct section (60) connected to an inlet has a connecting channel (62) to a first damping chamber (56) and also is connected via an inlet throttle member (61) to a second damping chamber (58) connected to an outlet via an outlet throttle member (51).

8. Pump according to claim 1, wherein a head cover of the diaphragm pump is formed as a connecting portion such that functional chambers of at least one of the excess pressure valve (27) and the oscillation chamber (16) are integrated into the connecting portion.

9. Pump according to claim 8, wherein the pulsation damping chamber(s) of the pressure-side pulsation damper (45) is/are formed both as the head cover of the pump and also as connecting portion to the oscillation chamber (16) and to the overflow valve.

10. Pump according to claim 1, wherein the suction-side oscillation chamber (16) has an oscillating diaphragm (10) which divides the oscillation chamber into a chamber portion connected to the suction side and a chamber portion connected via an aperture (17) to ambient air.

11. Pump according to claim 10, wherein the oscillating diaphragm (10) of the suction-side oscillation chamber has a diameter/thickness ratio adapted to a respective delivery medium for optimizing the oscillation damping.

12. Pump according to claim 1, wherein a heating arrangement (30, 31, 32) is integrated into the pump head.

* * * * *